US007900775B2

(12) United States Patent
Hojholt

(10) Patent No.: US 7,900,775 B2
(45) Date of Patent: Mar. 8, 2011

(54) PANEL TRANSPORT UNIT

(75) Inventor: Suzanne Hojholt, Fredericia (DK)

(73) Assignee: Saint-Gobain Isover, Courbevoie (FR)

( * ) Notice: Subject to any disclaimer, the term of this patent is extended or adjusted under 35 U.S.C. 154(b) by 481 days.

(21) Appl. No.: 11/814,421

(22) PCT Filed: Jan. 19, 2006

(86) PCT No.: PCT/FR2006/050026

§ 371 (c)(1),
(2), (4) Date: May 29, 2008

(87) PCT Pub. No.: WO2006/077347

PCT Pub. Date: Jul. 27, 2006

(65) Prior Publication Data

US 2009/0016867 A1 Jan. 15, 2009

(30) Foreign Application Priority Data

Jan. 20, 2005 (DK) ..... 2005 00104

(51) Int. Cl.
*B65D 19/00* (2006.01)

(52) U.S. Cl. ..... 206/597; 206/321; 206/497; 206/600

(58) Field of Classification Search ..... 206/321–323, 206/386, 497, 583, 597, 600, 599; 53/567
See application file for complete search history.

(56) References Cited

U.S. PATENT DOCUMENTS 3,385,678 A * 5/1968 Sorenson ..... 206/597
3,788,462 A * 1/1974 Meincer ..... 206/595
3,809,223 A * 5/1974 Kendall ..... 206/497
4,022,321 A * 5/1977 Barnett ..... 206/386
4,036,364 A * 7/1977 Ambrose ..... 206/497
4,095,692 A * 6/1978 Shelton ..... 206/386

FOREIGN PATENT DOCUMENTS

| | | | |
|---|---|---|---|
| DE | 17 56 480 | | 8/1970 |
| DE | 2 145 681 | | 4/1973 |
| DE | 77 21 991 | | 2/1978 |
| DE | 27 06 955 | | 8/1978 |
| DE | 39 18 311 | | 12/1989 |
| DE | 90 01 319 | | 4/1990 |
| DE | 42 18 354 | A1 | 12/1993 |
| EP | 0 005 056 | A2 | 10/1979 |
| EP | 0 764 579 | | 3/1997 |
| EP | 1 266 843 | A1 | 12/2002 |
| WO | WO 03/000567 | A1 | 1/2003 |
| WO | WO 2004/020305 | A1 | 3/2004 |

OTHER PUBLICATIONS

A. Ishlinsky, New Polytechnic Dictionary, Moscow, 2003, p. 630.
H. Kuchling, Physics, Moscow, 1980, pp. 137-139.

* cited by examiner

*Primary Examiner* — Luan K Bui
(74) *Attorney, Agent, or Firm* — Oblon, Spivak, McClelland, Maier & Neustadt, L.L.P.

(57) ABSTRACT

(EN) The invention relates to a transport unit (1), comprising several panels (2), piled in two or more piles (3), supported by one or more support elements (4) and wrapped in a single film (5). Each of said two or more piles (3) is separately supported by said one or more support elements (4) and the film is a stretch film in the form of a tube (5) with elastic radial properties and non-elastic axial properties which is arranged horizontally around the piles (3) and said one or more support elements (4) to hold the above together and to guarantee the stability of the transport unit (1) during manipulation and transport.

13 Claims, 1 Drawing Sheet

Fig. 1
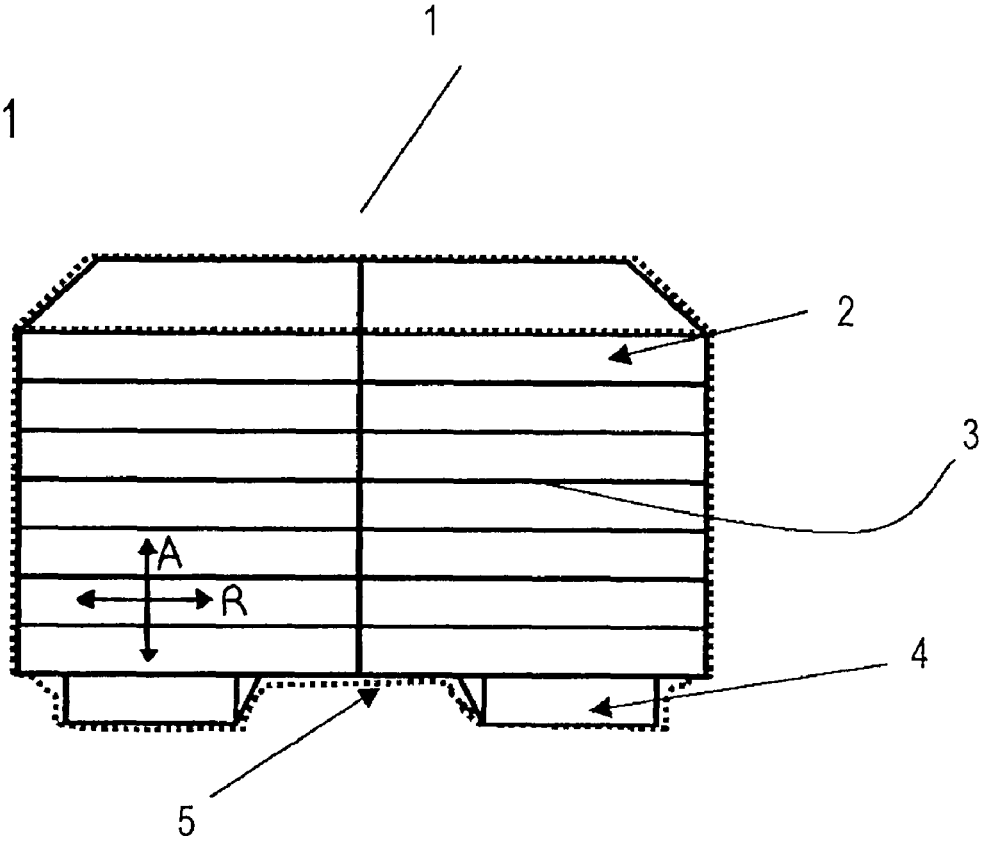
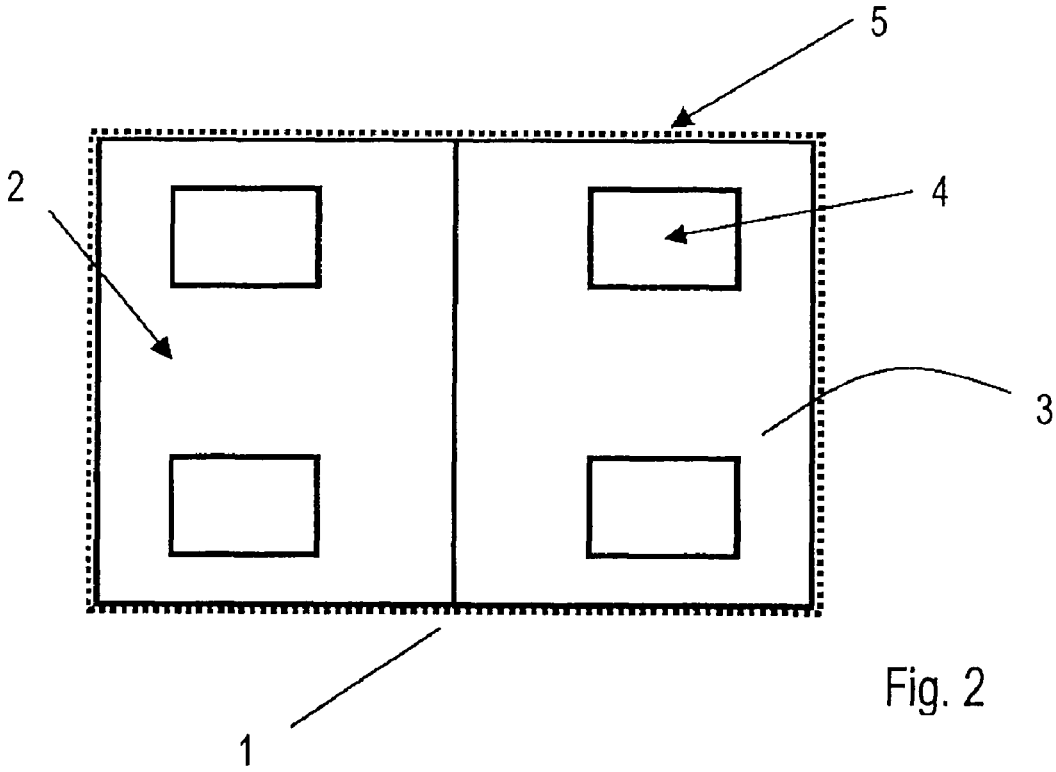
Fig. 2

PANEL TRANSPORT UNIT

The present invention relates to a transport unit comprising a number of boards stacked in two or more stacks, supported by one or more load carriers and enclosed by a common film.

Generally, when transporting large amounts of materials, the materials are packed on e.g. pallets to ease handling of the materials. The placement on pallets makes it possible to lift and move the materials with e.g. pallet lifting devices or forklift trucks. Pallets in different sizes, typically made out of wood or plastic material, are known and used within a large range of activities. The pallets are often heavy and must generally be stored by the recipient until they can be collected by the supplier and transported back to the producer. This involves a certain amount of movement of the pallets at the recipient's premises and furthermore requires extra storage space for the empty pallets. In situations where materials are to be used at places with limited access, e.g. inside buildings or on roofs, it is essential to have as little packaging material at hand as possible. The empty pallets are therefore an even larger problem in such places.

One proposal for solving this problem is known from DE 4218354, where the ordinary pallets are replaced with another type of load carrier that makes it possible to lift the materials above the ground in a similar way as pallets and thus enables handling with e.g. pallet lifting devices or forklift trucks. The load carriers are generally fastened to the material by wrapping with film. These load carriers are typically smaller and easier to handle than pallets. Obviously, the number of load carriers that is necessary depends on the shape, size and packaging of the material to be transported. When transporting a single stack of boards generally two load carriers are used, typically formed as boards that extend under the stack over the whole depth thereof.

When transporting several stacks of boards in one unit, problems arise when using separate load carriers instead of pallets. It is difficult to obtain a satisfactory support and stabilization of the stacks supported by load carriers, and there is a risk of insufficiently stabilized stacks turning over, putting the user at risk and causing problems.

Especially, a problem arises when the recipient of the stacks must be able to move separate stacks independently. This is very often necessary in e.g. building sites, where a limited amount from one unit is to be used at one spot. In that case each stack can be transported and stored in a stable way, i.e. without risk of it turning over for example.

A proposal to solve one of these problems, known from WO 03/000567, entails placing all stacks on top of an intermediate layer and then placing the load carriers under this intermediate layer. In this way a good stability is obtained during transportation, but in return both load carriers and the extra intermediate layer must then be disposed of. These devices represent just about as much extra material as an ordinary pallet. Furthermore it is very difficult or impossible to lift and transport only one of the stacks separately, which is frequently necessary, as stated above. Simply put, it is not possible to insert a pallet lifting device or the fork of a forklift truck between the large board and one of the stacks, as the stacks are placed directly on top of the board.

Another attempt to solve the abovementioned problems is known from EP 0946394 and encompasses the use of three load carriers for two stacks of boards. One of the load carriers is placed under the partition between the two stacks and parallel therewith, while the other two are placed nearer the edge, each under one stack and parallel with the central stacks. The stacks and load carriers are wrapped in one common film. However, this solution is very sensitive to the central load carrier being displaced. Such a displacement can make the stacks unstable and lead to them turning over. In that way, these units lead to high demands on precision in the production of the unit, which makes it more difficult and more expensive. Moreover, separation and separate moving of the two stacks lead to further problems, as only the load carrier closest to the edge follows each stack after the separation. The stack is not stable when it only rests on the load carrier that is placed closest to the edge and will turn over once it is put down. Obviously, this is both dangerous and not very practical. It is possible to support each stack manually after separation and movement, but this demands the presence of load carriers that can be used elsewhere and it is time consuming.

As stated, none of the known methods solves the problems of handling or movement of materials in a safe and efficient manner.

Generally, recipients of materials packed on pallets or other load carriers are for example large storage facilities or building sites. Both are work places where the work must be performed at a high speed and where there are already high risks involved in operation of machines and handling of materials. As a result, it is necessary that the handling of materials takes place as efficiently and with as low a risk as possible. Obviously, difficult procedures take time and thus make the work more expensive. Insecure handling and movement of materials add a further risk to the already dangerous work places.

There is, as it appears from the above, a need for providing a novel way of transporting materials which solves the above problems.

Furthermore, there is also a need for providing a transport unit which leaves as little packaging material as possible at the recipient's premises, but which at the same time is stable and safe to use.

There is also a need for providing a transport unit that makes it simple and safe to handle and move a single stack from a transport unit with a plurality of stacks.

Furthermore, there is a need for providing a transport unit that is simple and fast to produce.

It is the object of the present invention to provide a transport unit that complies with these needs and effectively solves the abovementioned problems.

The new and characterizing features of the invention are that each of two or more stacks is supported separately by said one or more load carriers, and that the film is a tube shaped stretch film with radial elastic properties and axial non-elastic properties, located horizontally around the stacks and said one or more load carriers to hold these together and ensure stability of the transport unit during handling and transport.

Separately supported should in this connection mean that each load carrier is placed solely under one stack and is thus not in contact with any space between the stacks.

By placing the tube shaped stretch film horizontally around the stacks and said one or more load carriers the stability of the transport unit is enhanced markedly and the number of load carriers is hereby minimized. Furthermore, the stacks and load carriers are kept together by the pressure that the stretch film produces. This pressure enhances the friction both between the stacks themselves and between the stacks and the load carriers. Hereby, mutual displacement of the stacks and of the load carriers in relation to the stacks is prevented effectively. This means that fewer load carriers may be used as the stacks, due to friction, keep each other in place. Thus, both enhanced stability and the possibility of using fewer load carriers without a need for further stabilization of the transport unit is achieved. Horizontal should in this connection be construed as essentially parallel with the upper and/or lower surfaces of the stacks.

Preferably, the tube shaped stretch film may be made of polyethylene, especially of low density polyethylene, with a radial direction and an axial direction and with elastic properties in the radial direction and non-elastic properties in the axial direction. The axial direction should in this connection mean the direction that is parallel with the central axis which extends through the hole in the tube shaped stretch film and out through both ends. The radial direction should mean the direction perpendicular to this central axis.

Preferably, the tube shaped stretch film has a thickness of around 30-200 μm, more preferably around 50-150 μm and most preferably around 80-130 μm.

The tube shaped stretch film may preferably be stretched around 5-100% in the radial direction, more preferably around 10-70% and most preferably around 15-50%.

These properties of the tube shaped stretch film make it possible to choose a stretch film with a smaller circumference than the circumference of the stacks and associated load carrier(s). The stretch film is extended radially so that the stacks and load carrier(s) may be moved horizontally inside the stretched film, and the stretch film will subsequently be placed tightly around stacks and load carrier(s) in the finished transport unit.

Preferably, the boards may be based on a material suited for insulation purposes, such as glass wool or rock wool. These materials are especially suited for incorporation in the transport unit according to the present invention, as the friction between insulation boards that are held together is very high. This friction contributes to the stability of the transport unit.

Furthermore, the boards may be produced on the basis of other materials suited for packaging in a transport unit of the present type, e.g. wood, plastic material, fibre material or rubber. These materials are all suited for transport in stacks using the present invention.

Preferably, said one or more load carriers may be made of the same material as the boards. This is advantageous, as it will be possible to use the load carriers with the process in which the transported boards are used. Hereby, the load carriers are no longer looked upon as packaging material and are therefore not to be disposed of in the usual manner. Thus, the amount of refuse that is inconvenient and troublesome to the recipient of the boards is minimized.

Furthermore, said one or more load carriers may be made of any solid material suited for support and transport, e.g. wood, metal, fibre material, etc. Solid material means in this connection that the material does not yield substantially when put under stress with a load. The essential issue is that the load carriers should not be compressed under the load, and the choice of material for the load carriers should therefore be adapted to the weight of the stacks.

Said one or more load carriers may be shaped as blocks, cubes, cylinders or have other geometrical shapes.

Preferably, said one or more load carriers may have a width, depth and height that substantially correspond to fractions of the spatial dimensions of the boards in such a way that a multiple of load carriers corresponds to one or more boards. This is advantageous as the load carriers may thus be handled easily in the work processes that are used for handling the boards.

Preferably, each stack may have a vertical plane of gravity with each load carrier located generally on a vertical line in relation to the vertical plane of gravity of the stack. Such a location of a load carrier in relation to a stack may make handling and movement of a separate stack simple and safe, as the stack can rest on the load carrier without a risk of turning over.

The vertical plane of gravity of a stack is in this connection supposed to mean the vertical plane that goes through the centre of gravity of the stack and that is perpendicular to the ends of the stack as well as the upper and lower surfaces and which is parallel with the sides of the stack.

Preferably, a predetermined distance between a plurality of load carriers may be 500 mm or more. Such a distance ensures that lifting arms from e.g. a forklift truck or a pallet lifting device of ordinary size may enter between the load carriers and thereby be able to lift the transport unit. By adaptation to other lifting methods or purposes, the load carriers may be located with any other advantageous distance therebetween which at the same time ensures the stability of the transported stacks and the transport unit as a whole.

Preferably, the number of load carriers in a given transport unit may be equal to or larger than the number of stacks in a given transport unit. Keeping the number of load carriers as low as possible ensures that the amount of packaging material is kept low even with transport units with several stacks. Thus, a transport unit is, in the case where the load carriers are produced of another material than the boards—all things being equal—advantageous in relation to a transport unit comprising a large number of load carriers, as the first leaves less packaging material in the form of load carriers after use.

Below, the invention will be explained in detail with reference to special preferred embodiments and the attached drawings in which:

FIG. 1 is a front view of a transport unit with two stacks and two load carriers, and FIG. 2 is a bottom view of two load transport units with two stacks and four load carriers.

Both figures are schematic and not to scale and only show parts that are necessary to elucidate the invention, while other parts are left out or only indicated. Identical reference numerals are used in all figures for identical or equivalent parts.

In perspective in FIG. 1 a transport unit 1 according to the invention is shown comprising boards 2, two stacks 3, load carriers 4 and a stretch film 5 located horizontally around the stacks and load carriers.

The boards 2 that are to form part of the transport unit 1 according to the invention may be made of e.g. wood, plastic material, metal, glass, stone, fibre material, rubber or a combination thereof. Preferably, the boards 2 according to the invention may be made of a material that can be used for insulation purposes, such as glass wool or rock wool.

Even though the transport unit 1 in FIG. 1 is shown with two stacks 3 of boards 2, it is according to the invention possible to use any other number of stacks 3, e.g. three, four or more.

Furthermore the invention is not limited to the use of two load carriers 4, but also comprises the use of three, four or more load carriers. Preferably, the number of load carriers 4 may be equal to or larger than the number of stacks 3. A relatively low number of load carriers 4 compared to the number of stacks 3 will—all things being equal—give an easier work routine during production of the transport units and will at the same time lead to less packaging material in the form of load carriers 4.

Said one or more load carriers 4 according to the invention may be made of a solid material suitable for support and load transport, e.g. wood, metal, fibre material, etc. Preferably, said one or more load carriers 4 may be made of the same material as the boards 2 in the transport unit 1. This is advantageous as the user of the boards 2 will thus typically be able to use said one or more load carriers 4 in the same working process and will thereby avoid having to dispose of them in another way. This is especially advantageous in cases where transport of materials to and from the site is difficult or involves big expenses, e.g. on roofs or inside buildings.

The stretch film 5 is in FIG. 1 placed horizontally around the stacks 3 and load carriers 4 and may according to the invention be made of polyethylene, especially low density polyethylene, with an axial direction (arrow A in FIG. 1) and a radial direction (arrow R in FIG. 1) and with elastic properties in the radial direction and non-elastic properties in the axial direction.

In a preferred embodiment the stretch film has a thickness of around 80-130 μm, but it is within the scope of the present invention to use a stretch film with other thicknesses, e.g. 30-200 μm or around 50-150 μm. In an embodiment of the invention the stretch film 5 may be stretched around 15-50% in the radial direction, but it is within the scope of the invention to use a stretch film 5 with other radial elastic properties, e.g. a possible stretch in the radial direction of around 5-100% or around 10-70%.

Even though, in preferred embodiments of the present invention, a stretch film 5 is used that is non-elastic in the axial direction, it could be contemplated that a stretch film 5 with certain elastic properties in the axial direction would be advantageous in other embodiments.

Generally the manufacturing of the transport unit 1 takes place in such a way that the boards 2 are first stacked in one or more stacks 3. Thereafter one or more load carriers 4 are generally placed on top of the stack 3. Hereafter the stacks 3 with said one or more load carriers 4 are, generally by means of a conveyor, transported to a unit that keeps a tube shaped stretch film 5 extended radially. Generally, the stretch film 5 is open at one end, but may be open at both ends. The stacks 3 with the load carriers 4 move inside the tube shaped stretch film 5 that is hereby separated from the unit that held it earlier and is thereby placed tightly around the stacks 3 and said one or more load carriers 4. The stretch film 5 will, after release from the unit that held it, contract strongly radially and thereby exert a force on the stacks 3 and load carrier (s) 4. This force holds the stacks 3 and load carrier(s) 4 together and enhances the friction therebetween. At the same time, the axial non-elastic properties of the stretch film 5 ensure that the stacks 3 are held together tightly and the friction between the stacks 3 makes the transport unit 1 stable. Finally, the tube shaped stretch film 5 is closed, generally by welding, the transport unit 1 is turned so that the load carriers 4 face down and is thereafter ready for collection or movement.

Surprisingly, the transport unit 1 with two stacks 3 of boards 2 may be transported separately in a stable way by only one load carrier 4 placed under each stack 3, without the need for a stabilizing connection between the two stacks 3, e.g. in form of a through-going board, a common load carrier under the space, etc. This has so far been an unimaginable solution, as the generally used minimum distance between the load carriers 4 of 500 mm combined with the width of the boards 2 would make the stacks 3 turn towards the centre and hereby make the unit unstable. Firstly, with the use of a transport unit 1 according to the present invention, it is possible to obtain the above stabilization, among other things due to the unforeseen and surprising stabilizing effect of the tube shaped stretch film 5.

FIG. 2 is a bottom view of a transport unit 1 according to the invention, comprising boards 2, two stacks 3, four load carriers 4 and one stretch film 5.

The load carriers 4 are in FIG. 2 shown as being rectangular, seen from below, but according to the invention the load carriers 4 may be shaped as blocks, cubes, cylinders or have other geometrical shapes.

Preferably the load carriers 4 have a width, depth and height that essentially correspond to fractions of the spatial dimensions of the boards 2. Generally, this means that a certain integral number of load carriers 4 have the same external dimensions as one or more of the boards 2. For instance, there may be four load carriers 4 under two stacks 3 of boards 2, where each load carrier 4 is approximately ¼ of the size of the board 2. Thus, the four load carriers 4 may together occupy the same space as one whole board 2 and thereby may easily be a part of the handling at the premises of the user in question. However, the dimensions of the load carriers 4 are not limited to said examples in the preferred embodiment described above.

Load carriers 4 with a width, depth and height that essentially correspond to fractions of the spatial dimensions of the boards are especially advantageous, if the load carriers 4 at the same time are made of the same material as the boards 2. Generally, the load carriers 4 may be used directly in the given working process.

The load carriers 4 are in FIG. 2 shown as being located with a certain distance therebetween. The distance between the load carriers 4 is defined as the length of the space between the load carriers 4 measured along the edge of the lower board(s) 2. This is the relevant distance, as it is here for instance that the lifting arms of a pallet lifting device or the forks of a forklift truck can enter under the transport unit 1. With different ways of moving or lifting the transport unit 1, the distance between the load carriers may be greater or lesser. Preferably, the load carriers 4 may have a predetermined distance therebetween of 500 mm or more. 500 mm is the usual minimum width of the lifting arms of a pallet lifting device or of a forklift truck and is therefore an especially advantageous distance between the load carriers 4, if the transport unit 1 is to be handled with a pallet lifting device or a forklift truck.

Furthermore, it is clear from the embodiment shown in FIG. 2 that the transport unit 1 in an advantageous way may be handled with a pallet lifting device or a forklift truck from all sides, as the four load carriers 4 are all located with these distances therebetween. Furthermore, this provides the advantage that if the tube shaped stretch film 5 is cut through at the gap between the two stacks 3, the two stacks 3 may be transported separately and be used in different places.

Preferably, the load carriers 4 may be located essentially in a vertical axis in relation to the vertical centre of gravity plane of at least one stack 3. Such a location enhances the stability of each stack 3 and thus makes this stack 3 stable after a possible separation from the transport unit 1. It is thus possible to move each stack 3 from a transport unit 1 without the risk of the stacks 3 turning over and putting the bystanders at risk.

Even though the invention in the above has been described in connection with preferred embodiments thereof, it is clear to someone skilled in the art that several modifications and improvements are feasible without departing from the scope of the invention as it is defined in the following claims.

Within the context of the present description, board means any volume of substantially parallelepipedal shape whose width is greater than its thickness by a factor at least equal to 2, or 5 or even 10.

A board according to the invention may consist of a single unit, typically an insulating board of conventional dimensions, or of a set of elementary units which can individually have diverse shapes and be linked together to form a modular structure of the substantially parallelepipedal shape described above. Such elementary units are for example rolls of insulation material linked together in the form of modules according to the packaging process described in patent EP 0 220 980 B1.

The invention claimed is:

1. A transport unit, comprising:

a plurality of boards stacked in two or more stacks;

one or more load carriers that each separately support one of the two or more stacks by being positioned under only the one of the two or more stacks and in contact with only one of the plurality of boards; and a common film to enclose the plurality of boards and the one or more load carriers, wherein the film is a tube shaped stretch film that is elastic in a radial direction and non-elastic in an axial direction, and the film is located horizontally around the stacks and the one or more load carriers to hold these together for stability of the transport unit during handling and transport.

2. A transport unit according to claim 1, wherein the tube shaped stretch film is made of polyethylene.

3. A transport unit according to claim 1, wherein the boards are made of an insulating material, glass wool, or rock wool.

4. A transport unit according to claim 1, wherein the boards are made of a packaging material suited for a transport unit, or of wood, plastic material, fiber material, or rubber.

5. A transport unit according to claim 1, wherein the one or more load carriers are made of a same material as the boards.

6. A transport unit according to claim 1, wherein the one or more load carriers are made of a solid material suited for support and transportation, or of wood, metal, fiber material.

7. A transport unit according to claim 1, wherein the one or more load carriers are shaped as blocks, cubes, cylinders, or have other geometrical shapes.

8. A transport unit according to claim 1, wherein the boards have spatial dimensions, and wherein the one or more load carriers have a width, a depth, and a height, and the width, the depth, and the height substantially correspond to fractions of the spatial dimensions of the boards.

9. A transport unit according to claim 1, wherein each of the stacks has a vertical center of gravity plane and each of the load carriers is located substantially in a vertical line with the vertical center of gravity plane of a corresponding one of the stacks.

10. A transport unit according to claim 1, comprising a plurality of the load carriers located with a predetermined distance therebetween, wherein the predetermined distance is 500 mm or more.

11. A transport unit according to claim 1, wherein the transport unit comprises a number of the stacks and a number of the load carriers, and wherein the number of the load carriers is equal to or larger than a number of the stacks.

12. A transport unit according to claim 1, wherein the film has a thickness of 80-130 μm.

13. A transport unit according to claim 1, wherein the film is low-density polyethylene.

* * * * *